United States Patent [19]

Herron

[11] Patent Number: 4,863,588

[45] Date of Patent: Sep. 5, 1989

[54] RIFFLE BARS

[76] Inventor: Lindsay G. Herron, Atley Downs, Arthurs Point, Queenstown, New Zealand

[21] Appl. No.: 54,307

[22] Filed: May 26, 1987

[30] Foreign Application Priority Data

May 28, 1986 [NZ] New Zealand ..... 216327

[51] Int. Cl.[4] ..... B03B 7/00

[52] U.S. Cl. ..... 209/44; 209/458; 209/507

[58] Field of Search ..... 209/44, 443, 458, 460, 209/471, 487, 506, 507; 210/521, 522; 138/106, 107; 239/556, 557, 566

[56] References Cited

U.S. PATENT DOCUMENTS

| | | | |
|---|---|---|---|
| 225,237 | 3/1880 | Reber | 138/107 |
| 252,793 | 1/1882 | Oliver | 209/458 |
| 433,882 | 8/1890 | Belding | 138/107 X |
| 847,519 | 3/1907 | Sloane | 209/506 X |
| 1,030,499 | 6/1912 | Wishart | 209/471 |
| 1,108,499 | 8/1914 | Hiltscher | 209/506 X |
| 1,364,991 | 1/1921 | Hayes, Jr. | 209/507 X |
| 1,620,142 | 3/1927 | Thompson | 239/566 X |
| 2,192,115 | 2/1940 | Ware | 239/557 X |
| 4,294,693 | 10/1981 | Brennan | 209/506 X |
| 4,592,833 | 6/1986 | Perdue | 209/44 |

FOREIGN PATENT DOCUMENTS 831180 5/1981 U.S.S.R. .

*Primary Examiner*—Robert B. Reeves
*Assistant Examiner*—Edward M. Wacyra
*Attorney, Agent, or Firm*—Wolf, Greenfield, & Sacks

[57] ABSTRACT

A hydraulically operated set of riffles includes a network of spaced-apart tubular riffle bars arranged to lie above a collecting surface in a riffle box. A plurality of generally downwardly directed apertures is formed in each riffle bar, and a flange extends generally upwardly along the length of the riffle bar. An inlet of each riffle bar is connected to a source of water or other fluid. In operation, water or other fluid that is supplied to the riffle bars passes forcibly outwardly through the apertures and is subsequently constrained to flow outwardly through the spaces between adjacent riffle bars to prevent undesired accumulation of particles between adjacent riffle bars.

7 Claims, 3 Drawing Sheets

RIFFLE BARS

This invention relates to a riffle bar and to a set of hydraulically operated riffle bars. The riffle bar or set of riffle bars may be used in a conventional riffle box.

The use of riffle bars in ore conditioners and separators is well known. For example, in gold mining, a riffle box, incorporating a plurality of spaced apart riffle bars, is commonly used in the separation of gold fines from gravel and other particulate material. Typically, a riffle box is used in an inclined plate with a collecting mat arranged on the floor of the box beneath a network or grill of riffles, to collect gold fines passing through the gaps between spaced apart riffle bars. The material to be sorted is passed downwardly over the riffle box, collision of the gravel or other particulate material with the riffle bars facilitating separating and sorting of the material.

One significant problem that is associated with riffle boxes and like arrangements is that large granular material tends to accumulate between adjacent riffle bars, such accumulation eventually negating the efficacy of the riffle box.

It is an object of the present invention at least to mitigate the problems associated with known riffle bar arrangements.

Accordingly, in its broadest aspect, the invention provides a riffle bar, for use in a riffle box or a like arrangement, comprising a tubular element adapted to be supported in a framework, the element having inlet means for connection to a water supply, a plurality of generally downwardly directed apertures being formed along the length of the bar and a flange element extending outwardly from the tubular element at a position generally opposite to the apertures.

In a particularly preferred arrangement, the tubular element has a generally square cross section, a series of apertures being formed along adjacent first and second faces of the element and the flange element extending from the apex of the opposite two faces. In such an arrangement the riffle bar would be arranged for support in the framework with the apex formed between said first and second faces pointed in a generally downwardly direction.

In a further aspect, the invention provides an hydraulically operated set of riffles, comprising a network of spaced-apart tubular riffle bars arranged to lie above a collecting surface in a riffle box, a plurality of generally downwardly directed apertures being formed in each riffle bar and a flange extending generally upwardly along the length of the bar, the bars being connected to a source of water or other fluid, in operation, water or fluid being supplied to the riffle bars to pass forcibly outwardly through the apertures and subsequently being constrained to flow outwardly through the spaces between adjacent riffle bars to prevent undesired accumulation of particles between adjacent bars.

Conveniently, one or more conventional riffle bars may be interspaced between hydraulic riffles in the set.

Preferably, the riffle bars are arranged in parallel between spaced apart parallel frame elements. Desirably a first such frame element is in the form of a distributing manifold, having a water inlet means and a plurality of water outlets, each water outlet being arranged for sealable connection with the inlet means of a riffle bar.

Conveniently, said second frame element comprises a simple side plate or sealing element.

Advantageously a divider bar may be provided to lie adjacent the tops of the riffle bars between said frame elements.

A perforate mesh may lie atop the riffle bars, the perforation being of a size to provide primary screening of material.

In order that the present invention may be more readily understood, and so that further features thereof will be appreciated, an embodiment of a riffle bar, and a set of hydraulically operated riffle bars, for use in a riffle box, and incorporating such riffle bar, will now be described by way of example, with reference to the accompanying drawings, in which:-

Figure 1:
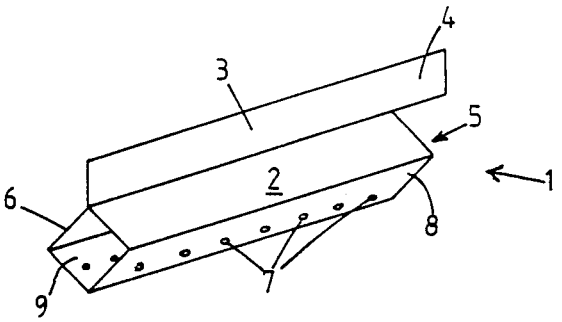
FIG. 1 is a perspective view of a riffle bar of the invention.

Referring to FIG. 1, a riffle bar 1 comprises a square section tubular element 2 and an upstanding flange 3 connected along one longitudinal edge of the element 2. An end portion 4 of the flange 3 extends outwardly of a first end 5 of the element 2 and, as will be explained further herein below, provides means for mounting the riffle bar in frame elements of a set of riffle bars. The first end 5 of the element 2 defines an inlet for supply of water to the riffle bar. The other end 6 is closable by a plate or seal (not shown in FIG. 1).

A plurality of outlet apertures 7 are formed in longitudinal series along adjacent sides 8, 9 of the element 2. As will be appreciated from the drawing, the sides 8 and 9 are those sides generally opposite to the longitudinal edge from which the flange 3 projects.

Figure 2:
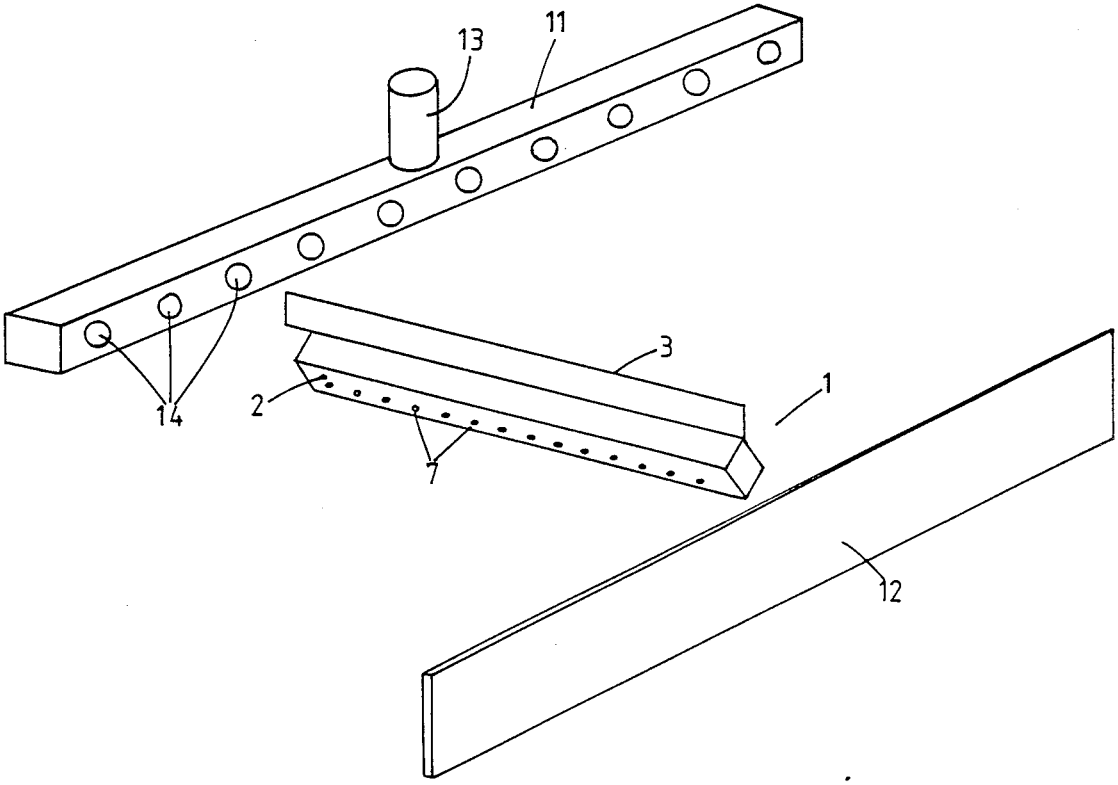
FIG. 2 is an exploded perspective view illustrating parts of a set of riffle bars.
Figure 3:
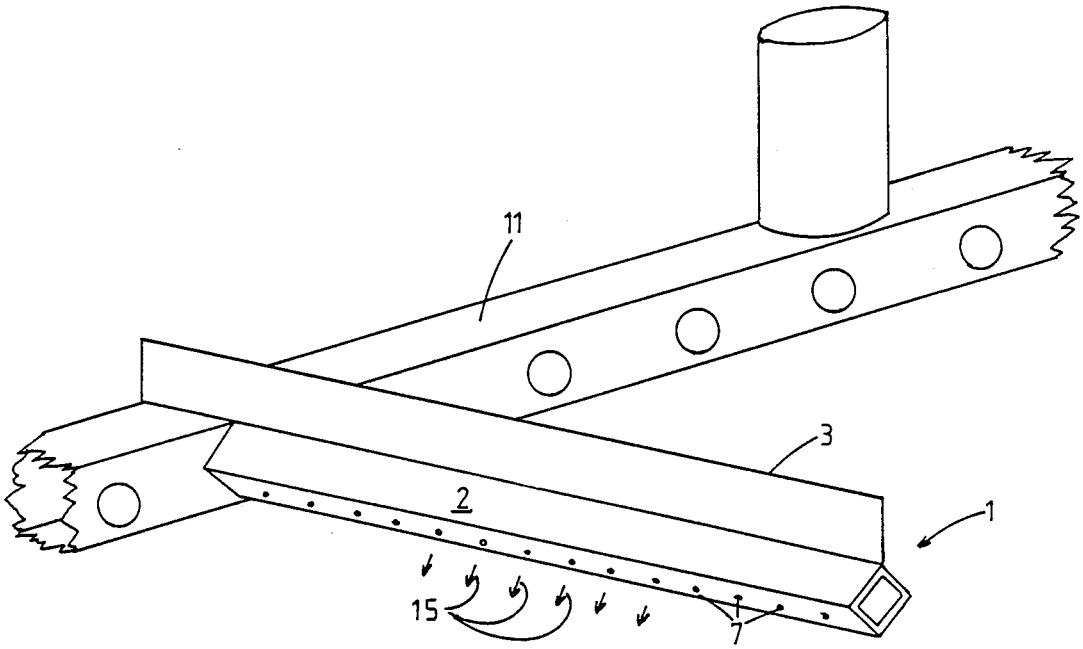
FIG. 3 is a view similar to FIG. 2 illustrating a riffle bar in position on a distributing manifold element.
Figure 4:
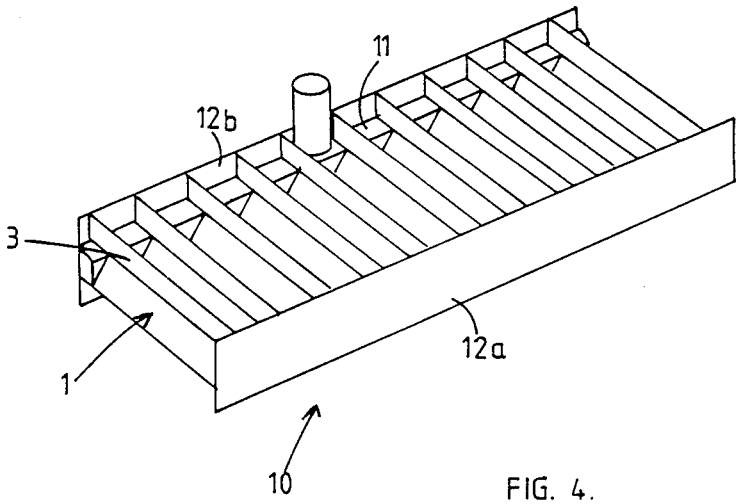
FIG. 4 is a perspective view of a set of hydraulically operated riffle bars.

Referring now to FIGS. 2 to 4, a set of riffle bars 10 incorporating a plurality of riffle bars 1 is described. As best seen in FIG. 4, the set of riffle bars 10 comprises a plurality of spaced apart riffle bars 1, each riffle bar 1 being connected, via the end portion 4 of flange 3 to a supporting manifold 11. Side plates seals **12*a* and 12*b* are arranged transversely of the riffle bars 1, the side plates 12*a* and 12*b* being arranged transversely of the riffle bars to form side rails of the set of riffle bars. Additionally, the side plate 12*a* acts to close the ends 6** of the riffle bars.

The manifold element 11 comprises a single inlet means 13 and a plurality of outlet ports, one positioned to co-operate with the inlet of each riffle bar. Sealing means (not shown) may be associated with each outlet port 14.

The riffle bars may be constructed from any suitable material, or combination of materials, for example a suitable metal, fibreglass, plastics or rubber material. The various elements may be interconnected in any suitable manner, for example by welding, where appropriate, adhesive or by use of a secondary fastening means, such as bolts, screws or other clamping means.

The manifold inlet 13 is arranged for connection to a water supply, for example by means of a hose. A plurality of sets of riffle bars may be connected to a single water source.

Figure 5:
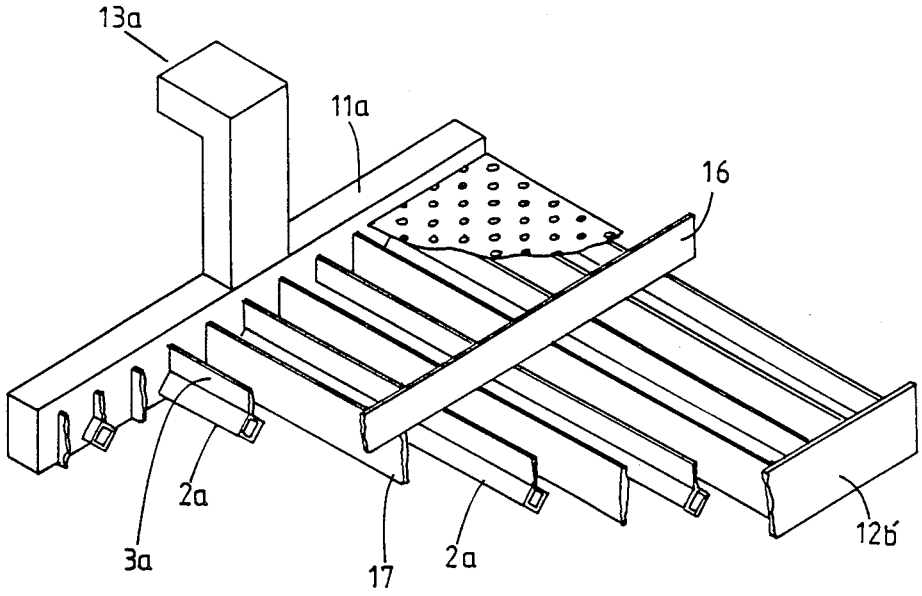
FIG. 5 is a perspective view illustrating parts of a further embodiment of the invention.
Figure 6:
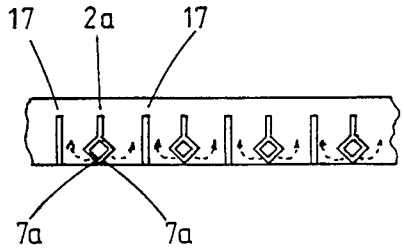
FIG. 6 is a schematic sectional view of the embodiment of FIG. 5, with parts thereof omitted for the sake of clarity.

Referring to FIGS. 5 and 6 an alternative arrangement of riffle bars 2*a* is illustraed. As in the embodiment described above, the riffle bars 2*a* are mounted between a manifold element 11*a* and a side plate 12*b*'. Flanges 3*a* of the riffle bars 2*a* extend upwardly from an apex of the bars. The bars are mounted between the manifold and side plate so that the flange does not extend above the upper limit of these elements. A divider 16 is mounted atop the riffle bars parallel with the manifold and side plate to facilitate even flow of material over the riffle bars. A screen mesh or perforated plate overlies the riffles to provide primary screening of material.

As indicated in FIG. 6 a plurality of downwardly directed apertures 7*a* are formed in the tubular riffle bars 2a. The tubular riffle bars 2*a* are separated by conventional flat plate riffles 17.

In use, the set of riffle bars is arranged in an inclined plane and positioned over a collecting surface or mat in a riffle box. Water is supplied to the manifold 11, 11a via inlet 13, 13*a* and passes from the manifold into each of the riffle bars 1. Due to the build-up of water pressure within the manifold and riffle bars, the water is ejected through the apertures 7, 7*a* in the form of jets as indicated by the arrows 15 in FIGS. 3 and 6. Due to the positioning of the set of riffle bars 10 over a collecting surface, at least a portion of the water emanating downwardly from the riffle bars is subsequently constrained to flow upwardly between adjacent riffle bars, the continuous flow of water having an agitating effect and serving to prevent dirty water and material from settling between the riffles. The water flowing upwardly from between adjacent riffle bars also serves to provide a smoother flow path for material passing over the riffle box. In the embodiment of FIGS. 5 and 6, the flow of water, or other fluid, from the apertures 7*a* has been found to be sufficient to keep the spaces between riffles clear in many circumstances.

The size and spacing of the apertures 7, 7*a* and the selection of either tubular hydraulic riffles alone or in combination with conventional riffles will depend upon the material being worked and the working conditions encountered.

It will be appreciated that the present invention provides numerous advantages over known arrangements. In particular the provision of hydraulic riffle bars enables the pumping of clean water, at an even pressure, underneath all of the riffles in a riffle box and the subsequent upward flow of this water prevents the undesired accumulation of gravel, etc., from hindering operation of the riffle box. Additionally, by providing for a smoother flow path of material over the riffle box the volume of material that may be processed is increased.

I claim:

1. A hydraulically operated set of riffles, comprising a network of spaced-apart tubular riffle bars arranged to lie above a collecting surface in a riffle box, a plurality of generally downwardly directed apertures being formed in each riffle bar and a flange extending generally upwardly along the length of each riffle bar, an inlet means of each riffle bar being connected to a source of water or other fluid, in operation, water or fluid being supplied to the riffle bars to pass forcibly outwardly through the apertures and subsequently being constrained to flow outwardly through the spaces between adjacent riffle bars to prevent undesired accumulation of particles between adjacent riffle bars.

2. Apparatus according to claim 1, wherein one or more conventional riffle bars is interspaced between tubular riffles in the set.

3. Apparatus according to claim 1 or 2, wherein the riffle bars are arranged in parallel between spaced apart parallel frame elements.

4. Apparatus according to claim 3, wherein one of said frame elements is in the form of a distributing manifold, having a water inlet means and a plurality of water outlets, each water outlet being arranged for sealable connection with the inlet means of one of said tubular riffle bars.

5. Apparatus according to claim 4, wherein a second of said frame elements comprises a simple side plate or sealing element.

6. Apparatus according to claim 1, wherein a divider plate is provided to lie adjacent the tops of the riffle bars between spaced-apart, parallel frame elements which form said riffle box.

7. Apparatus according to claim 1, wherein a perforate mesh lies atop the riffle bars, the mesh including perforations of a size to provide primary screening of material to be sorted by the set of riffles.

* * * * *